US011725487B2

(12) United States Patent
Kovalchuk et al.

(10) Patent No.: US 11,725,487 B2
(45) Date of Patent: Aug. 15, 2023

(54) CONFORMABLE SAND SCREEN

(71) Applicants: Anton Kovalchuk, Houston, TX (US); Anil Sadana, Houston, TX (US)

(72) Inventors: Anton Kovalchuk, Houston, TX (US); Anil Sadana, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/167,664

(22) Filed: Feb. 4, 2021

(65) Prior Publication Data

US 2022/0243566 A1 Aug. 4, 2022

(51) Int. Cl.
*E21B 43/10* (2006.01)
*E21B 43/08* (2006.01)

(52) U.S. Cl.
CPC ..... *E21B 43/108* (2013.01); *E21B 43/082* (2013.01); *E21B 2200/08* (2020.05)

(58) Field of Classification Search
CPC ... E21B 43/108; E21B 43/082; E21B 2200/08
See application file for complete search history.

(56) References Cited

U.S. PATENT DOCUMENTS 2,796,939 A * 6/1957 Woodruff ..... E21B 43/082 210/275
3,099,318 A * 7/1963 Miller ..... E21B 43/082 166/227
7,284,603 B2 * 10/2007 Ohmer ..... E21B 43/103 166/207
7,712,529 B2 * 5/2010 Dusterhoft ..... E21B 43/086 166/278
8,664,318 B2 * 3/2014 Guest ..... C08L 77/10 524/439
9,212,541 B2 * 12/2015 Richard ..... E21B 43/082
10,233,746 B2 * 3/2019 Johnson ..... E21B 47/08
2005/0139359 A1 * 6/2005 Maurer ..... E21B 43/108 166/207
2008/0149351 A1 * 6/2008 Marya ..... E21B 41/00 166/387
2010/0051271 A1 3/2010 Gano et al.
(Continued)

OTHER PUBLICATIONS

Notification of Transmittal of the International Search Report and the Written Opinion of the International Searching Authority, or the Declaration; PCT/US2022/070532; dated May 10, 2022; 9 pages.

*Primary Examiner* — Jonathan Malikasim
(74) *Attorney, Agent, or Firm* — Cantor Colburn LLP

(57) ABSTRACT

A sand control tool including a base pipe having a radial port through a wall thereof, a plurality of volume increasing members disposed upon the base pipe, a filtration segment disposed upon the base pipe and disposed between and in physical contact with ones of the plurality of members, and a cover disposed radially outwardly upon the plurality of members and plurality of segments. An embodiment of a sand control tool including a base pipe having a radial port through a wall thereof, a volume increasing member helically disposed upon the base pipe, a filtration segment helically disposed upon the base pipe adjacent the member, and a cover disposed radially outwardly upon the member and segment.

12 Claims, 3 Drawing Sheets

(56) References Cited

U.S. PATENT DOCUMENTS

| | | | | |
|---|---|---|---|---|
| 2012/0067587 | A1* | 3/2012 | Agrawal | C08J 9/36 166/309 |
| 2012/0090839 | A1 | 4/2012 | Rudic | |
| 2019/0390544 | A1 | 12/2019 | Junwen et al. | |
| 2020/0080401 | A1 | 3/2020 | Sherman | |
| 2021/0025251 | A1* | 1/2021 | Xi | C09J 133/04 |
| 2021/0123310 | A1* | 4/2021 | Fripp | E21B 23/01 |

* cited by examiner

CONFORMABLE SAND SCREEN

BACKGROUND

In the resource recovery industry, sand control is always an issue. Many sand control tools are currently available to the art but due to the plethora of unique conditions extant in various well systems, the art is always in need of additional configurations that address issues like higher temperature and greater borehole conformance, for example.

SUMMARY

An embodiment of a sand control tool including a base pipe having a radial port through a wall thereof, a plurality of volume increasing members disposed upon the base pipe, a filtration segment disposed upon the base pipe and disposed between and in physical contact with ones of the plurality of members, and a cover disposed radially outwardly upon the plurality of members and plurality of segments.

An embodiment of a sand control tool including a base pipe having a radial port through a wall thereof, a volume increasing member helically disposed upon the base pipe, a filtration segment helically disposed upon the base pipe adjacent the member, and a cover disposed radially outwardly upon the member and segment.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
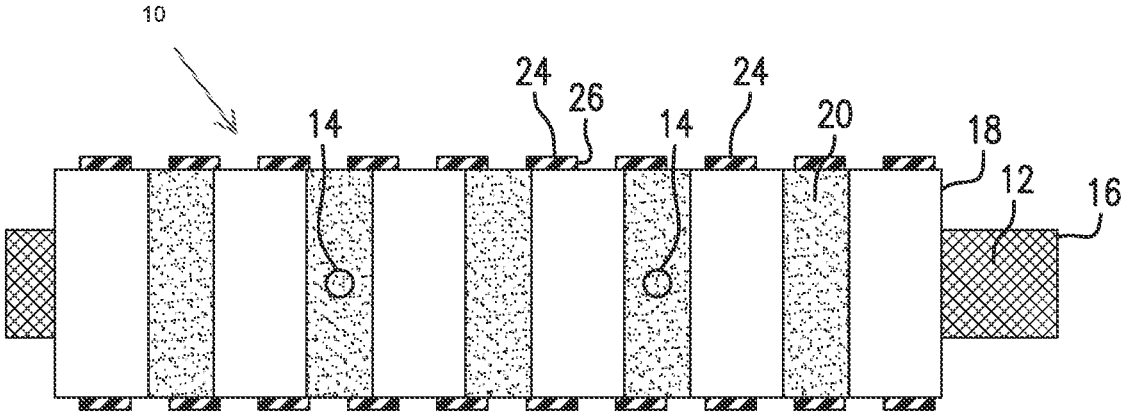
FIG. 1 is a schematic side view of a sand control tool as disclosed herein.

Referring to FIG. 1, a first embodiment of a sand control tool 10 is illustrated. The tool 10 comprises a base pipe 12 having one or more ports 14 extending through a wall 16 thereof. In embodiments, there will be many ports 14 as one of skill in the art might expect in a base pipe for a sand screen. Radially outwardly and upon the base pipe 12 are a number of volume increasing members 18. As illustrated, the members 18 number 6 but more or fewer are contemplated. The members 18 are spaced apart from one another on the base pipe 12. The members comprise a material or materials that are capable of expand radially when exposed to a trigger such as a wellbore fluid or water or temperature or combinations including at least one of the foregoing. The members may be hydrophilic, oleophilic or both as desired. In an embodiment, the members are swellable rubber material, while in another embodiment the members are closed cell expandable foams, for example epoxy foam, EPDM foam, polyurethane foam, polystyrene foam, PTFE foam, etc. In yet other embodiments, a combination of materials may be employed using one or more of the foregoing. Expansion of the members 18 will provide wellbore conformance of the tool as the members 18 will tend to ensure contact around 360 degrees of a borehole in which the tool 10 is placed. In the illustrated embodiment, there are six members 18 distributed longitudinally along the base pipe 12. Even distribution helps ensure good conformance to the shape of the borehole in which the tool 10 is set.

As illustrated in FIG. 1, the members are essentially annular in shape having an axis that is substantially the same as the axis of the base pipe 12. Along that axis, the members have a thickness. The thickness is selected for various expansion ratios that may be desirable, for example, to make the tool 10 usable in a range of borehole or casing sizes.

Interspersed between the members 18 are filtration segments 20. The segments 20 comprise a filtration material such as gravel, polymer gravel, beads (such as those available from Baker Hughes in bead pack products), polystyrene beads, crosslinked polyethylene or PEX, cured epoxy resin beads, phenolic resin beads, polyamide beads, PEEK granules, polyimide granules, etc, and combinations including at least one of the foregoing. Alternatively, the pack may be inorganic gravel pack material (ceramic, large sand, resin-coated sand, crushed concrete, etc.) and combinations including at least one of the foregoing. The segments 20 are compressed between the members 18 at least when the tool 10 is set in the borehole but in embodiments will also be compressed between the members 18 prior to setting. A thickness of the segments 20 is generally less than that of the members 18. In embodiments, the ratio of thickness of the members 18 to the segments 20 is about 2:1 to about 5:1.

Still referring to FIG. 1, an optional cover 24 is illustrated radially outwardly of the members 18 and segments 20. The cover is useful to help contain the segments 20 or their constituent particles in case they are not stabile in shape on their own. In one embodiment, the cover must be able to pass fluid so it is configured either with openings 26 or is a flow through material. In another embodiment however, the cover is constructed from a material that will degrade in downhole conditions in a selected period of time. Examples of the degradable material include degradable epoxy, degradable polyurethane, bismaleimides (BMI), polyamide PGA, PLA, PVA, etc. In an embodiment, the cover is rubber material such as modified NBR, HNBR, NBR, EPDM, SBR or the like.

Figure 2:
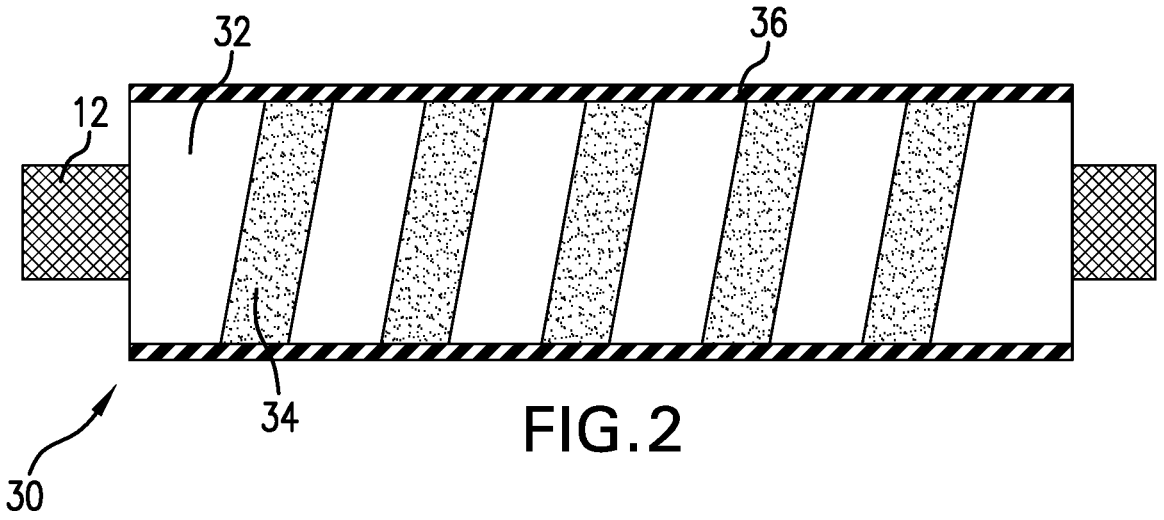
FIG. 2 is a schematic side view of an alternate sand control tool as disclosed herein.

Referring to FIG. 2, another embodiment of a sand control screen 30 is illustrated. The concept is quite similar but here the volume increasing member 32 is interspersed with the filtration segment 34 via a helical layout. Each of the volume increasing member 32 and the filtration segment 34 form their own helices. The helices then are wound together and on the base pipe 12. An optional cover 36 may be fitted radially outwardly of the member 32 and segment 34 as in the embodiment of FIG. 1 and be constructed of the same materials. The materials for the member 32 and the segment 34 are the same as for the embodiment of FIG. 1.

The tools as disclosed herein exhibit excellent conformity and high temperature stability (300 degrees Fahrenheit or more).

Figure 3:
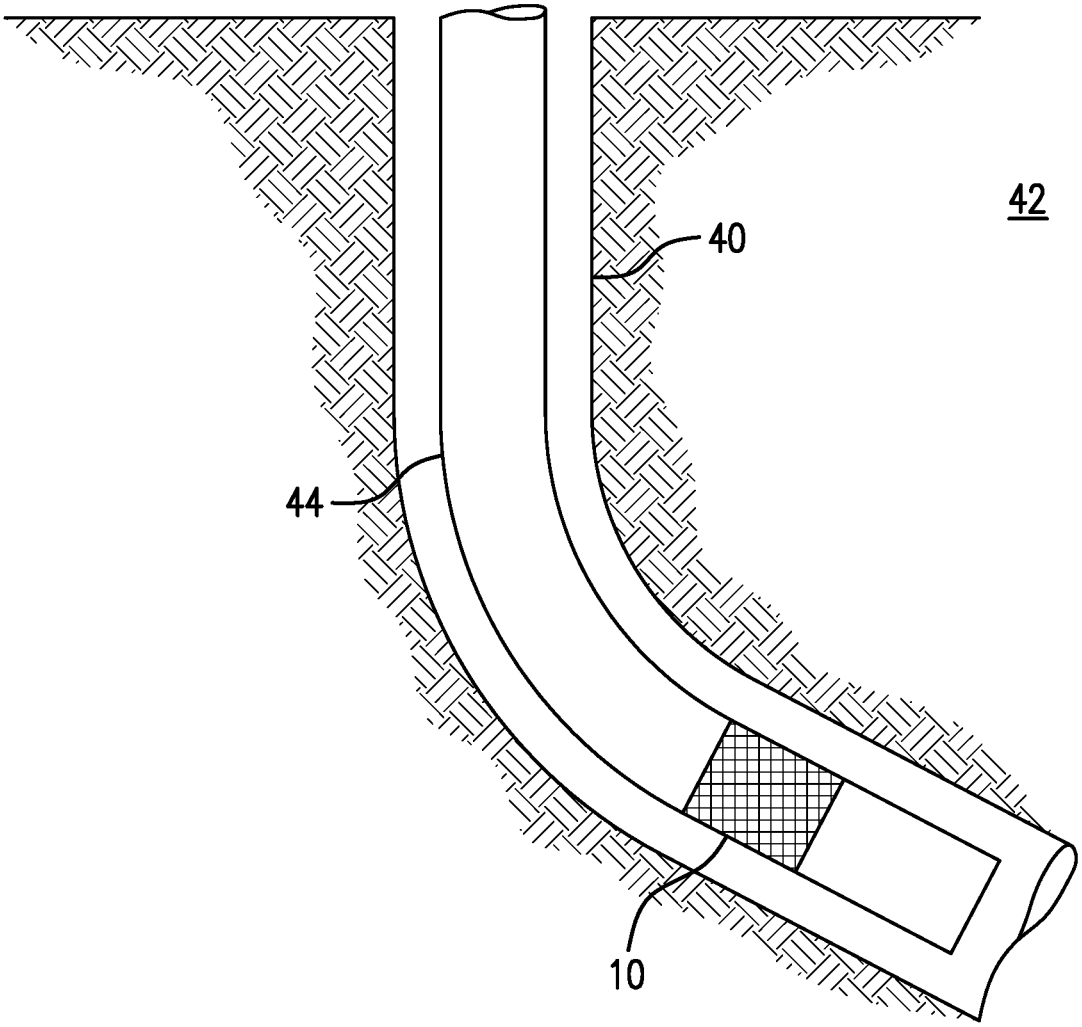
FIG. 3 is a schematic representation of a well system including a sand control tool as disclosed herein.

FIG. 3 illustrates the tool 10 as a part of a well system. Tool 10 is depicted in a borehole 40 in a formation 42. The tool 10 may be a part of a string 44 disposed within the borehole 40.

Set forth below are some embodiments of the foregoing disclosure:

Embodiment 1: A sand control tool including a base pipe having a radial port through a wall thereof, a plurality of volume increasing members disposed upon the base pipe, a filtration segment disposed upon the base pipe and disposed between and in physical contact with ones of the plurality of members, and a cover disposed radially outwardly upon the plurality of members and plurality of segments.

Embodiment 2: The tool as in any previous embodiment, wherein the cover is expandable and fluid permeable.

Embodiment 3: The tool as in any previous embodiment, wherein the cover is degradable.

Embodiment 4: The tool as in any previous embodiment, wherein the plurality of volume increasing members are expandable members.

Embodiment 5: The tool as in any previous embodiment, wherein the plurality of volume increasing members are at least 3 members and the filtration segment is at least two segments ones of at least two segments being interposed between each of the at least three members.

Embodiment 6: The tool as in any previous embodiment, wherein the plurality of volume increasing members compress the segment therebetween.

Embodiment 7: The tool as in any previous embodiment, wherein the plurality of volume increasing members are annularly shaped.

Embodiment 8: The tool as in any previous embodiment, wherein the plurality of volume increasing members have a thickness longitudinally along the tool that ranges from about 2:1 to about 5:1 a longitudinal thickness of the segment.

Embodiment 9: The tool as in any previous embodiment, wherein the filtration segment includes one or more of an inorganic pack material, a particulate based filter, a polymer gravel pack material, and a nutshell pack material.

Embodiment 10: The tool as in any previous embodiment, wherein the filtration segment is a shape memory material.

Embodiment 11: The tool as in any previous embodiment, wherein the cover includes radially directed holes.

Embodiment 12: The tool as in any previous embodiment, wherein the cover is an elastomer.

Embodiment 13: The tool as in any prior embodiment, wherein the cover is expandable.

Embodiment 14: The tool as in any previous embodiment, wherein the cover retains the segment.

Embodiment 15: A sand control tool including a base pipe having a radial port through a wall thereof, a volume increasing member helically disposed upon the base pipe, a filtration segment helically disposed upon the base pipe adjacent the member, and a cover disposed radially outwardly upon the member and segment.

Embodiment 16: A method for using the tool as in any previous embodiment, including running the tool into a borehole, and allowing the plurality of members to volumetrically increase to conform to the borehole.

Embodiment 17: The method as in any previous embodiment further including producing fluid through the tool.

Embodiment 18: A system including a borehole in a formation, and a tool as in any previous embodiment disposed in the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for controlling sand in a borehole comprising:

running a tool comprising a base pipe having a radial port through a wall thereof;

a plurality of volume increasing members disposed upon the base pipe;

a filtration segment disposed upon the base pipe and disposed between and in direct physical contact with ones of the plurality of members; and a cover disposed radially outwardly upon the plurality of members and the filtration segment into the borehole;

allowing the plurality of members to volumetrically increase; and conforming the tool to the borehole.

2. The method as claimed in claim 1, including expanding the cover and passing fluid through the cover.

3. The method as claimed in claim 1, including degrading the cover.

4. The method as claimed in claim 1 wherein the plurality of volume increasing members are at least 3 members and the filtration segment is at least two segments ones of at least two segments being interposed between each of the at least three members.

5. The method as claimed in claim 1 wherein the plurality of volume increasing members compress the segment therebetween, causing the segment to extend radially into conformance with the borehole.

6. The method as claimed in claim 1 wherein the plurality of volume increasing members are annularly shaped.

7. The method as claimed in claim 1, wherein the plurality of volume increasing members have a thickness longitudinally along the tool that ranges from about 2:1 to about 5:1 of a longitudinal thickness of the segment.

8. The method as claimed in claim 1, wherein the filtration segment includes one or more of an inorganic pack material, a particulate based filter, a polymer gravel pack material, and a nutshell pack material.

9. The method as claimed in claim 1, wherein the filtration segment is a shape memory material.

10. The method as claimed in claim 1, wherein the cover includes radially directed holes.

11. The method as claimed in claim 1, wherein the cover is an elastomer.

12. The method as claimed in claim 1 further including producing fluid through the tool.

* * * * *